United States Patent [19]

Campbell

[11] Patent Number: 5,031,505

[45] Date of Patent: Jul. 16, 1991

[54] VARIABLE FREQUENCY CONTROL FOR PERCUSSION ACTUATOR

[75] Inventor: Paul B. Campbell, Roanoke, Va.

[73] Assignee: Ingersoll-Rand Company, Woodcliff Lake, N.J.

[21] Appl. No.: 394,885

[22] Filed: Aug. 17, 1989

[51] Int. Cl.[5] ..... F01L 25/04

[52] U.S. Cl. ..... 91/300; 91/302; 91/403

[58] Field of Search ..... 91/249, 250, 251, 256, 91/285, 300, 302, 403

[56] References Cited

U.S. PATENT DOCUMENTS

| | | | |
|---|---|---|---|
| 217,952 | 7/1879 | Neff . | |
| 806,128 | 12/1905 | Flottmann . | |
| 3,741,072 | 6/1973 | Romell et al. . | |
| 3,995,700 | 12/1976 | Mayer et al. . | |
| 4,077,304 | 3/1978 | Bouyoucos | 91/276 |
| 4,143,585 | 3/1979 | Selsam | 91/276 |
| 4,172,411 | 10/1979 | Matsuda et al. . | |
| 4,425,835 | 1/1984 | Krasnoff . | |

*Primary Examiner*—Allen M. Ostrager
*Attorney, Agent, or Firm*—Glenn B. Foster

[57] ABSTRACT

A variable frequency control for a hydraulic percussion actuator includes a piston bore and a valve bore. A piston is axially disposed within the piston bore, while a valve is axially disposed within the valve bore. A first piston biasing member biases the piston in a first direction while a second piston biasing member, which overcomes the bias of the first piston biasing member to move the piston in a second direction. A first valve biasing pin biases the valve in a third direction while a second valve biasing pin overcomes the bias of the first valve biasing pin to move the valve in a fourth direction. A hydraulic valve actuator displaces the second valve biasing pin when the piston is extended in the second direction, and a piston actuator activates the second piston biasing pin when the valve is extended in the fourth direction. A valve response member controls the time required for the valve to be displaced in said fourth direction upon actuation of said valve actuating member.

11 Claims, 1 Drawing Sheet

VARIABLE FREQUENCY CONTROL FOR PERCUSSION ACTUATOR

BACKGROUND OF THE INVENTION

This invention relates generally to a piston stroke control, and more specifically to a variable frequency control for a percussion actuator.

U.S. Pat. No. 3,995,700 issued to Mayer et al discloses a hydraulic rock drill system in which the frequency of a hammer stroke is controlled by adjusting the pressure required for a closure member to open. The stroke frequency is thus altered by changing the period required by the hammer to respond to the opening of a valve. In comparison, the instant invention alters the stroke of the piston by changing the period required for the valve to complete its motion once the motion has begun.

U.S. Pat. No. 4,425,835 issued to Krasnoff discloses a fluid actuator involving a piston 28, and a valve 36. The valve controls the pressure exerted on the piston. The amount of pressure existing in cushion chamber 14 determines how quickly the valve will respond to the any motion of the piston 28.

The Krasnoff valve does not affect the time it takes from when the valve is moved from the at rest position to the position at which the pressure is effectively switched to the piston, as is the case in the instant invention.

The forgoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a an actuator having a frequency control including a piston bore and a valve bore, and a piston being axially disposed within the piston bore while a valve is axially disposed within said valve bore. A first piston biasing means biases the piston in a first direction while a second piston biasing means overcomes the bias of the first piston biasing means to move the piston in a second direction. A first valve biasing means biases the valve in a third direction while a second valve biasing means overcomes the bias of the first valve biasing means to move the valve in a fourth direction;

A valve actuating means actuates the second valve biasing means whenever the piston is extended in second direction, and a piston actuating means actuates the second piston biasing means whenever the valve is extended in the fourth direction.

The forgoing and other aspects will become apparent from the following detailed description of the invention when considered in conjunction with the accompanying drawing. It is to be expressly understood, however, that the drawing figures are not intended as a definition of the invention, but are for the purpose of illustration only.

DETAILED DESCRIPTION

Figure 1:
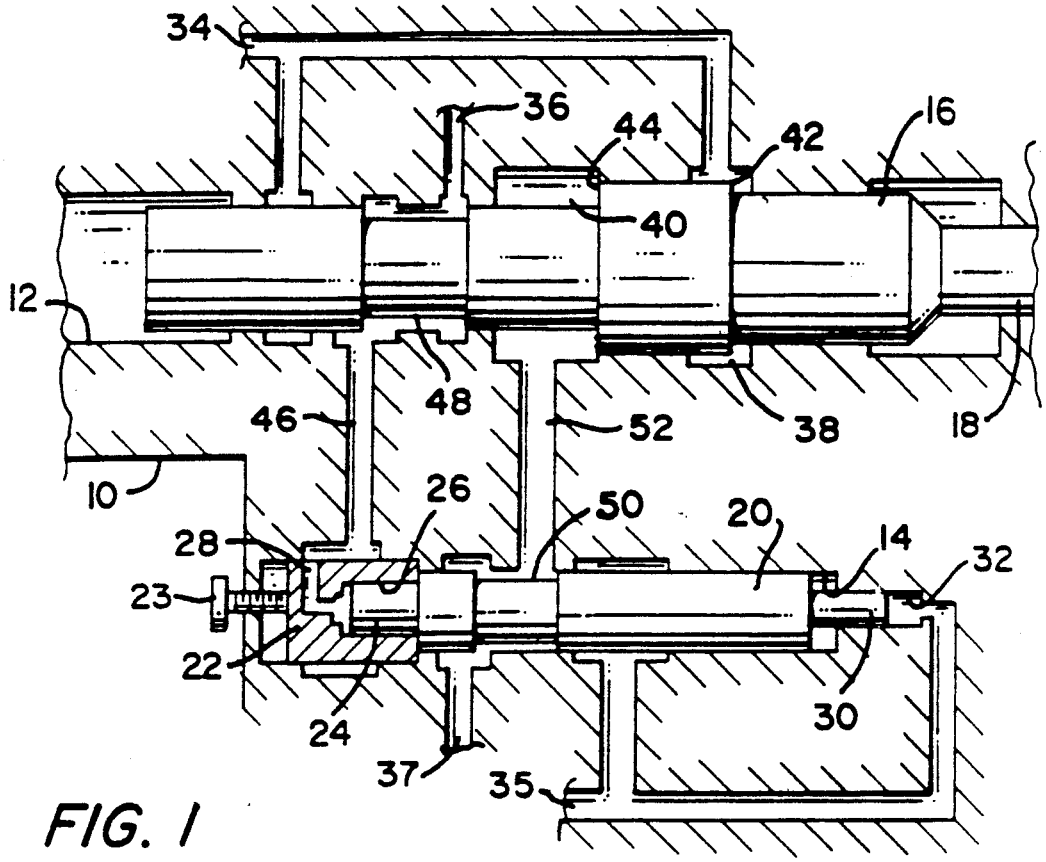
FIG. 1 is a schematic view illustrating one embodiment of the variable frequency control for a percussion actuator of the instant invention, with the piston 16 being displayed positioned to the right of its stroke.
Figure 2:
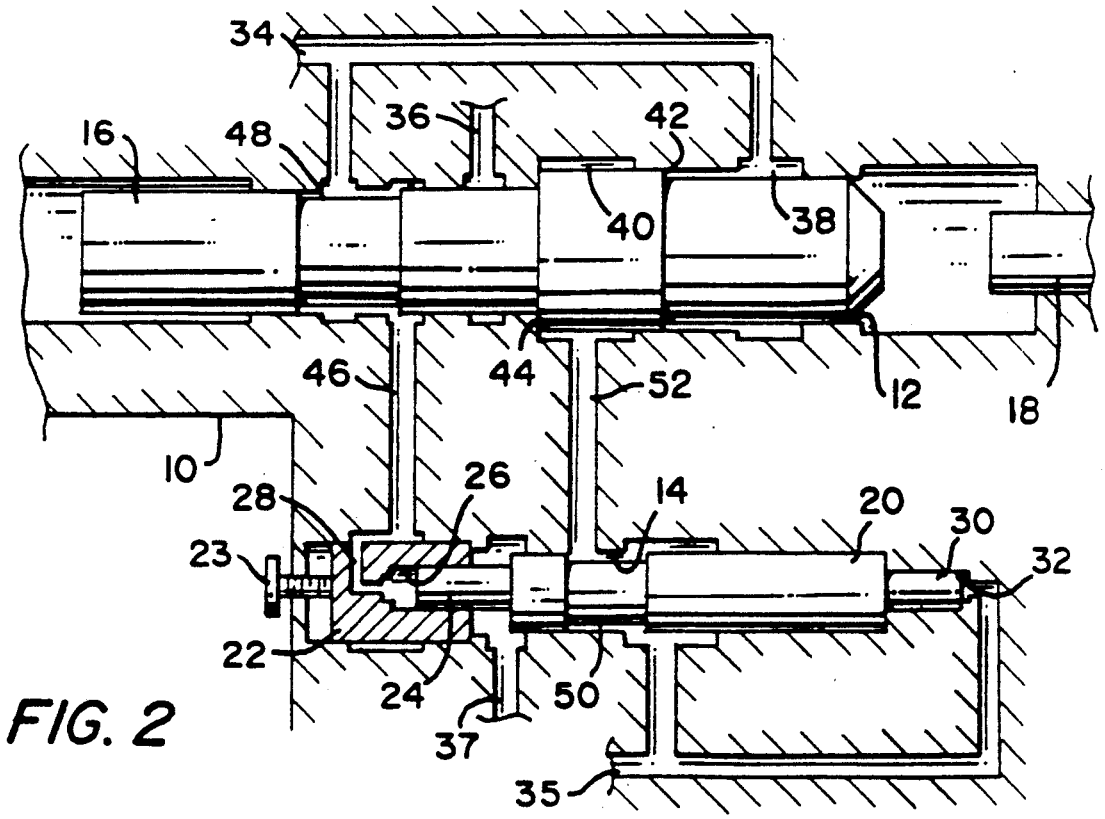
FIG. 2 illustrates a schematic view similar to FIG. 1, with the piston 16 being displayed positioned to the left of its stroke.

Referring now to the drawings, FIGS. 1 and 2 illustrate an embodiment of the frequency control for a percussion actuator of the instant invention. Identical elements will be similarly numbered throughout the figures.

A housing 10 is formed with a piston bore 12 and a valve bore 14. A piston 16 is slidingly displaced within the piston bore. The piston is shaped as a series of coaxial cylinders of differing diameters. The piston is displaced between a down position in which it contacts striking block 18 and an up position which is removed from the block 18. Any impact force on the striking block 18 will be transmitted through differing elements to the tool bit, not shown, as is well known in the art.

A valve 20 and a stroke limiter or second valve biasing means 22 are disposed within the valve bore 14. The stroke limiter 22 may be lockingly displaced within the valve bore 14 by adjustment of a locknut 23, such that the stroke of the valve 20 may be adjusted. Notice that the farther left (as viewed in the Figures) the stroke limiter 22 is locked, the greater the possible stroke of the valve 20.

Even though a locknut arrangement 23 is shown in the drawings as the device which controls the position of the stroke limiter, it is anticipated that any other system which permits easy movement, with positive locking of the stroke limiter 22 within the valve bore 14 could be used in this embodiment of the instant invention.

A pin 24 is disposed within a pin recess 26 formed in the stroke limiter 22. A fluid channel 28 connects the outside of the stroke limiter to the pin recess 26 such that pressure may act on the pin 24 to force the pin out of the pin recess 26, which acts to displace the valve 20 towards the right (as viewed in the Figures). A pin 30 is disposed within a pin recess or first valve biasing means 32 formed in the housing 10. Any force on the pin 30 will cause the valve to be displaced towards the left.

It is envisioned that hydraulic fluid would most often be used to displace the various elements in the instant embodiment. However other means, such as electromechanical energy or pneumatics, could be used without departing from the scope of the invention.

A high pressure source 34 and a low pressure source 36 interact to move the piston 16, while a high pressure source 35 and a low pressure source 37 interact to move the valve 20. The low pressure sources 36, 37 may be atmospheric, or a somewhat lower pressure than the corresponding high pressure sources.

Piston 16 is moved as a result of fluid pressure acting upon pressure surfaces 42 and 44. Pressure surface or piston biasing means 42 is exposed to constant high pressure port 38 which continually acts to displace the piston 16 to the left. Pressure surface 44 is contained within pressure port 40. The surface area of the pressure surface 44 is larger than the area of pressure surface 42 such that when equal high pressure exists in pressure ports 38 and 40, the force which is exerted upon pressure surface 44 exceeds the force exerted on pressure surface 38 and the piston 16 is moved to the right.

Whether high pressure exists in pressure port 40 depends on the position of valve 20 as will be described later.

The pressure which exists in a pressure conduit or valve actuating means 46 depends upon the position of the piston 16. When the piston is moved to the right, the connector sleeve 48 will connect the low pressure port 36 to the pressure conduit. When the piston 16 is moved to the left, the connector sleeve will connect the high pressure port 34 to the pressure conduit 46.

The channel 28 communicates the pressure in the pressure conduit 46 to the pin recess 26 such that when, and only when, there is high pressure in the pressure conduit, will the valve 20 be moved to the right under the direct action of the pin 24.

The position of the valve 20 determines the position of the piston in the following manner. When the valve is to the right, a connector sleeve 50 communicates the pressure of the high pressure port 35 to a pressure conduit or piston actuating means 52, forcing the piston 16 to move, ultimately impacting into the striking block 18, at the piston's furthest right position. When the valve 20 is to the left, the connector sleeve communicates the low pressure source 35 to the pressure conduit, permitting the piston 16 to return to the raised position.

OPERATION

Since the stroke limiter 22 can be adjusted and locked within the valve bore 14, the further the stroke limiter 22 is to the left, the greater the stroke of the valve 20, and therefore the greater the time which is necessary for the valve to complete its stroke from the left to the right.

During the initial period that the valve is moving to the right, the pressure conduit 52 is still in communication with the low pressure port 37 via connector sleeve 50. During this period, the high pressure is acting on the pressure surface 42 of the piston 16, moving the piston to the left. Only when the connector sleeve 50 moves to the position where high pressure port 35 becomes in communication with pressure conduit 52 is the travel of the piston 16 reversed.

Only at those times that the piston 16 is to the left will the high pressure source 34 be in communication with the pressure conduit 46. This is the only period in which the bias of the pin 24 will overcome the bias of the pin 30, resulting in valve movement to the right.

In the above manner, the frequency of impacts between the piston 16 and the striking block can be decreased by increasing the stroke of the valve 20 by moving the stroke limiter 22 to the left. Also note that the lower the frequency of the piston 16, the greater the distance that the piston will travel while a constant high pressure force is acting on the pressure surface 44, and therefor the higher will be the impact force between the piston 16 and the striking block 18.

While this invention has been illustrated and described in accordance with the preferred embodiments, it is recognized that variations and changes may be made therein without departing from the invention as set forth in the claims.

What is claimed is:

1. An actuator having a frequency control comprising:

a housing having a piston bore and a valve bore formed therein;

a piston axially disposed within said piston bore;

a valve axially disposable within said valve bore;

first piston biasing means for biasing the piston in a first direction;

second piston biasing means for overcoming the bias of the first biasing means to move the piston in a second direction;

first valve biasing means for biasing the valve in a third direction;

second valve biasing means for overcoming the bias of the first valve biasing means to move the valve in a fourth direction;

valve actuating means for actuating the second valve biasing means when the piston is extended in the first direction;

piston actuating means for actuating the second piston biasing means when the valve is extended in the fourth direction; and valve response means for controlling the stroke of the valve whereby the time period required for the valve to be displaced in said fourth direction is changed, said second piston biasing means being constantly applied to the piston during a portion of the time period.

2. A frequency control for a piston as defined in claim 1, wherein said valve response means comprises a stroke limiter which is lockingly and movably disposed within said valve bore.

3. A frequency control for a piston as defined in claim 1, wherein said first piston biasing means comprises a high pressure port acting on a pressure surface formed on said piston.

4. A frequency control for a piston as defined in claim 1, wherein said second piston biasing means comprises a high pressure port acting on a pressure surface formed on said piston.

5. A frequency control for a piston as defined in claim 1, wherein the first valve biasing means comprises a pin which is disposed within a pin recess.

6. A frequency control for a piston as defined in claim 1, wherein the second valve biasing means comprises a pin which is disposed within a pin recess.

7. An actuator having a frequency control comprising:

a housing having a piston bore and a valve bore formed therein;

a piston axially disposed within said piston bore;

a valve axially disposed withn said valve bore;

first piston biasing means for biasing the piston in a first direction;

second piston biasing means for overcoming the bias of the first piston biasing means to move the piston in a second direction;

first valve biasing means for biasing the valve in a third direction;

second valve biasing means for overcoming the bias of the first valve biasing means to move the valve in a fourth direction;

valve actuating means for actuating the second valve biasing means when the piston is extended in the first direction;

piston actuating means for actuating the second piston biasing means when the valve is extended in the fourth direction; and stroke limiting means for controlling the stroke of the valve whereby the time period required for the valve to be displaced in said fourth direction is changed, said second piston biasing means being constantly applied to the piston during a portion of the time period.

8. A frequency control for a piston as defined in claim 7, wherein said first piston biasing means comprises a high pressure port acting on a pressure surface formed on said piston.

9. A frequency control for a piston as defined in claim 7, wherein said second piston biasing means comprises a high pressure port acting on a pressure surface formed on said piston.

10. A frequency control for a piston as defined in claim 7, wherein the first valve biasing means comprises a pin which is disposed within a pin recess.

11. A frequency control for a piston as defined in claim 7, wherein the second valve biasing means comprises a pin which is disposed within a pin recess.

* * * * *